United States Patent [19]

Imai

[11] Patent Number: 4,734,053

[45] Date of Patent: Mar. 29, 1988

[54] ELECTRICAL CONNECTOR

[75] Inventor: Akira Imai, Yokohama, Japan

[73] Assignee: AMP Incorporated, Harrisburg, Pa.

[21] Appl. No.: 70,635

[22] PCT Filed: Oct. 24, 1985

[86] PCT No.: PCT/US85/02073

§ 371 Date: May 30, 1986

§ 102(e) Date: May 30, 1986

[87] PCT Pub. No.: WO86/03345

PCT Pub. Date: Jun. 5, 1986

Related U.S. Application Data

[63] Continuation of Ser. No. 879,222, May 30, 1986, abandoned.

[30] Foreign Application Priority Data

Nov. 29, 1984 [JP] Japan ..... 59-252772

[51] Int. Cl.[4] ..... H01R 9/07

[52] U.S. Cl. ..... 439/329; 439/494

[58] Field of Search ..... 339/17 F, 176 MF, 75 MP; 439/67, 77, 260, 267, 329, 492–499

[56] References Cited

U.S. PATENT DOCUMENTS

| | | | |
|---|---|---|---|
| 2,995,617 | 8/1961 | Maximoff et al. | 174/153 |
| 3,601,775 | 8/1971 | Longenecker et al. | 339/176 MP |
| 3,696,319 | 10/1972 | Olsson | 339/17 F |
| 3,941,448 | 3/1976 | Evans | 339/176 MF |
| 3,980,375 | 9/1976 | LaMarche | 339/61 M |
| 3,989,336 | 11/1976 | Rizzo, Jr. et al. | 339/74 R |
| 4,188,086 | 2/1980 | Inouye et al. | 339/176 MP |
| 4,480,886 | 11/1984 | Bergamin | 339/75 MP |
| 4,519,133 | 5/1985 | Pansanel | 339/75 MP |

FOREIGN PATENT DOCUMENTS

| | | |
|---|---|---|
| 0011923 | 6/1980 | European Pat. Off. . |
| 0099680 | 2/1984 | European Pat. Off. . |
| 2257158 | 8/1975 | France . |
| 124794 | 10/1978 | Japan . |
| 124793 | 10/1978 | Japan . |
| 118289 | 7/1982 | Japan . |

OTHER PUBLICATIONS

"Connectors for Dense PCB Packaging" (Electronic Product News, 7/84).

"ZIF Connector for .049" Pitch FFC/FPC (5597/5598 Series)"–Molex Catalog, p. 2K.

Flat Flex Connector (7583–CN)"–Molex Catalog, p. 6K.

"Flat Flex Connector (4850)"–Molex Catalog, p. 8K.

"ZIF Flat Flex Connector (90067)"–Molex Catalog, p. 12K.

"FLEXLOK CIC Series Conductive Ink Circuitry Connector"–Burndy Catalog, p. 2.

"FLEXLOK FC Series"–Burndy Catalog, p. 28.

"FLEXLOK Type HBLB–R and HBLB–S"–Burndy Catalog, p. 29.

*Primary Examiner*—John McQuade

*Attorney, Agent, or Firm*—Eric J. Groen

[57] ABSTRACT

An electrical connector for a flat cable comprising a base housing (30) accommodating electrical contacts (50) and a cover housing (10) which is arranged to slide vertically with respect to the base housing. The cover housing and the base housing have grooves (11*a*, 11*b*) which mate with guide projections (31*a*, 31*b*) to guide the relative movement between the housings. The cover housing at a first position enables a part of a flat cable (1) to be positioned in an opening (45) of the base housing and upon movement of the cover housing to a second position, a projection (14) of the cover housing presses exposed conductors of the flat cable in engagement with the contacts. The cover housing can be maintained at its first position by a first locking means (31*a*) and at its second position by a second locking means (16, 37).

20 Claims, 9 Drawing Figures

ELECTRICAL CONNECTOR

This application is a continuation of application Ser. No. 879,222, filed May 30, 1986, now abandoned.

This invention relates to an electrical connector to be mounted on a printed circuit board, and more particularly an electrical connector for a resilient flat cable.

Recently, there has been increased usage for a resilient flat cable which can be connected to electrical wiring for high density equipment usage so as to make small-sized and light-weight electrical equipment. Along with this increased use, since several electrical connectors need to be mounted in a printed circuit board in a high density fashion, it is required to provide a smaller-sized electrical connector. As an electrical connector for a resilient flat cable to be mounted to a printed circuit board, a known electrical connector comprises an insulating housing having a plurality of contact elements with contact arms contacting with the conductor parts within the opening so as to receive the conductor part of the flat cable and a plug member is hingedly connected to the housing and having a projection capable of being fitted into said opening.

In order to connect the flat cable by using this connector, the conductor part of the flat cable is inserted into the opening with the projection being fitted into the opening. Thus, the conductor part is pushed by the projection into contact with the contact arms so as to accomplish the electrical connection. However, in the case where flat cable is to be connected to a connector on a printed circuit board, other components mounted under high density conditions on the printed circuit board may hinder the flat cable, with the result that it sometimes is difficult to move the plug member relative to the housing and, further, it is hard to connect the flat cable or remove it from the connector.

In view of the foregoing, it is an object of the present invention to provide an electrical connector for a flat cable in which the flat cable can be connected or removed without being hindered by other components on the printed circuit board.

The present invention comprises an electrical connector comprising an insulating housing provided with an opening opened to face upward for use in receiving exposed conductors of a resilient flat cable, a plurality of contact elements having resilient contact arms arranged in said opening and contact legs passing through the bottom part of the insulating housing and projecting downwardly and fixed in a row in the insulating housing, and a plug member having a projection inserted into said opening to cause the exposed conductors of the flat cable received in said opening to be contacted with the resilient contact arms and is characterized in that guide grooves are formed at both sides of one of the insulating housing or plug member, guide projections are located at both sides of the other member, the guide grooves and the guide projections cooperate so as to cause the plug member to be slidable relative to the housing. The guide projections are slidably and forcedly mated with the guide grooves at the cable receiving position where the plug member is moved upwardly and the plug member is held stationary at this position and the exposed conductors of the flat cable can be received in the opening in the insulating housing whereby the projection of the plug member is inserted into the opening as the plug member is moved downwardly causing the exposed conductors to be electrically engaged with the resilient contact arms of the contact elements.

FIGS. 1 and 2 are perspective views showing the electrical connector of the present invention, respectively, wherein FIG. 1 shows a condition in which a plug member is located at a cable receiving position, and FIG. 2 shows a condition in which a plug member is located at the cable connecting position;

Figure 1:
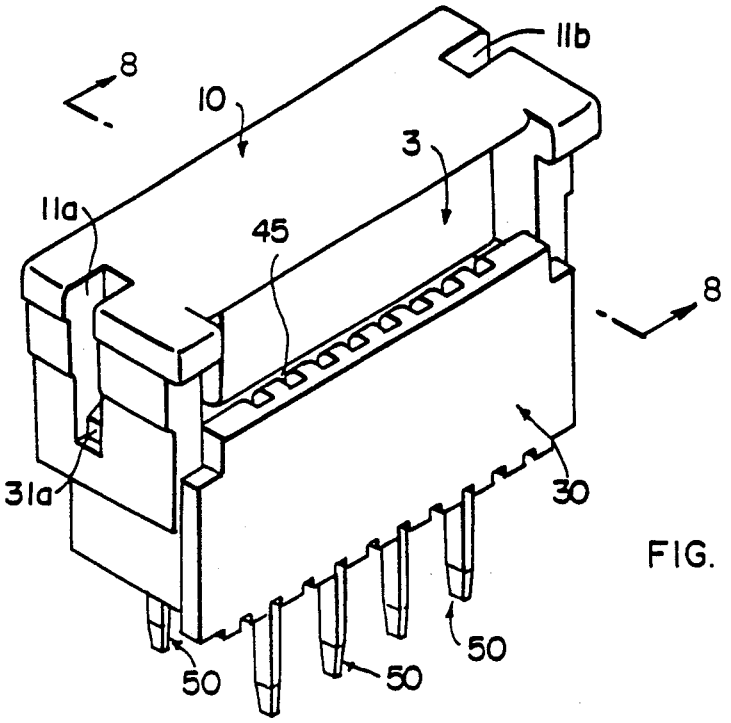

Referring now to the drawings, one preferred embodiment of the present invention will be described.

Figure 2:
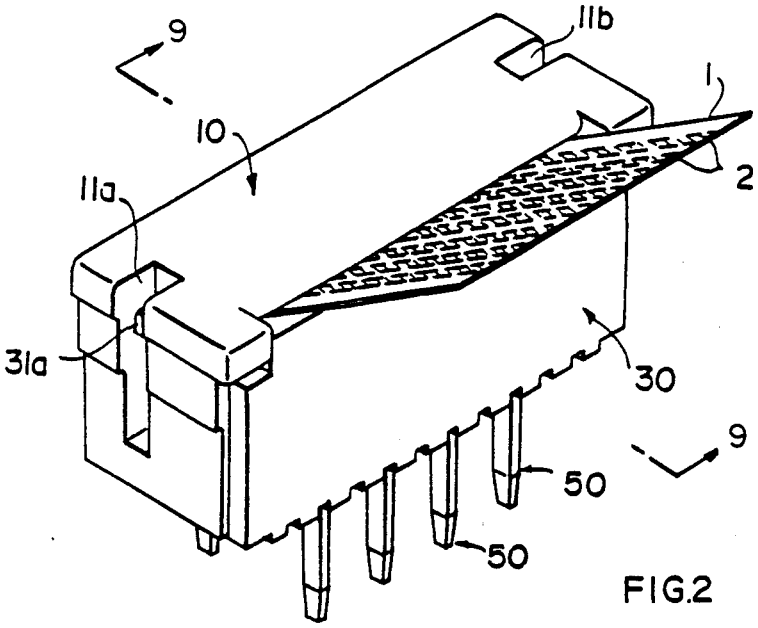

FIGS. 1 and 2 are perspective views for showing one example of an electrical connector of the present invention. FIG. 1 shows a condition in which the plug member 10 is moved upwardly in respect to the insulating housing 30 and placed at a cable receiving position. FIG. 2 shows a condition in which the plug member 10 is moved downwardly and placed at a cable connecting position.

This electrical connector is comprised of the insulating housing 30 having guide projections 31*a* and 31*b* at both ends thereof. A plurality of contact elements 50 are arranged in an opening 45 formed in insulating housing 30 while a plug member 10 has guide grooves 11*a* and 11*b* so as to be fitted to the guide projections 31*a* and 31*b* at both ends thereof. The plug member 10 is slidable upwardly and downwardly with respect to insulating housing 30 under the engagement of the guide projections 31*a* and 31*b* and the guide grooves 11*a* and 11*b*. Guide projections 31*a*, 31*b* can be on plug member 10 and guide grooves 11*a*, 11*b* can be on insulating housing 30 if desired.

Figure 3:
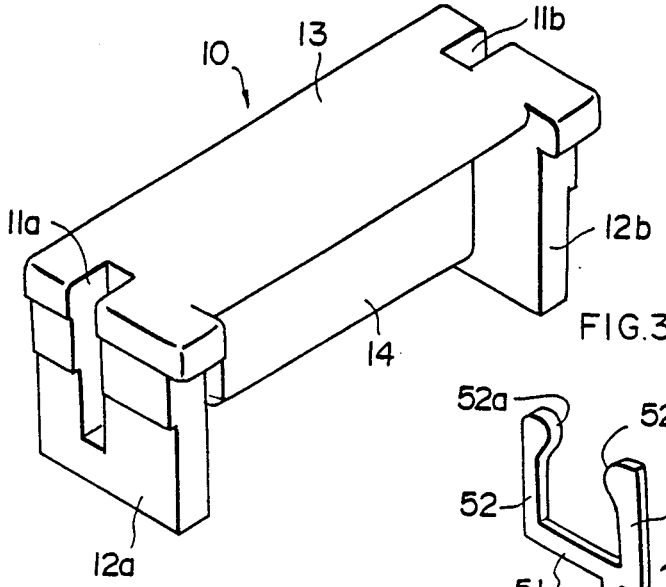
FIGS. 3 to 5 are perspective views showing a plug member, contact element and insulating housing having contact elements therein for forming an electrical connector of the present invention.

FIG. 3 is a perspective view showing plug member 10, which is preferably made of a suitable insulating plastic material. Guide grooves 11*a* and 11*b* are formed at both side walls 12*a* and 12*b*, and a downwardly extending projection 14 is formed at the lower surface of the upper wall 13 connecting the upper ends of both side walls 12*a* and 12*b*.

Figure 4:
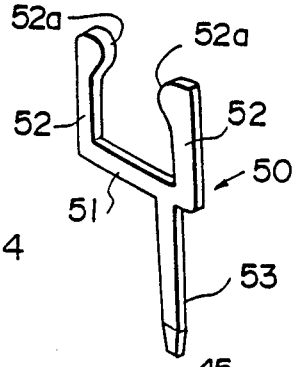

FIG. 4 is a perspective view showing electrical contact 50 which is stamped from metal having resilient characteristics and it has a pair of resilient contact arms 52 extending upwardly from the ends of a base part 51 and they face slightly inwardly. A contact leg 53 extends downwardly and vertically from one side of base part 51, while the upper ends of resilient contact arms 52 are formed with inwardly projecting contact sections 52*a*.

Figure 5:
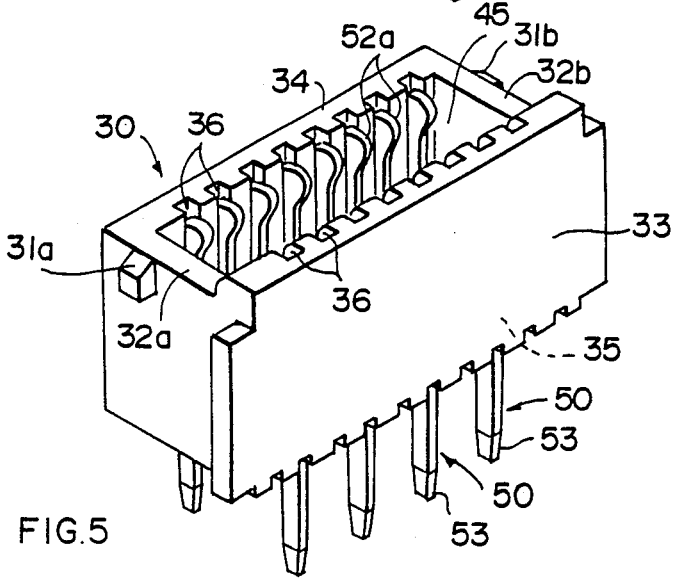

FIG. 5 is a perspective view showing a plurality of contact elements 50 secured within insulating housing 30. Insulating housing 30 is made of a suitable resilient plastic material and formed as a box-like shape having side walls 32*a*, 32*b*, a front wall 33, a rear wall 34 and a bottom wall 35, and further has an opening 45 enclosed by these walls and opened to face upward. A plurality of grooves 36 are located on the inner surfaces of walls 33, 34, 35 for receiving and holding contact elements 50. Contact elements 50 are arranged in grooves 36 in an alternating reverse pattern such that contact legs 53 pass through the bottom wall 35 and project downwardly in a zig-zag form. The outer surfaces of both side walls 32*a* and 32*b* are formed with guide projections 31*a* and 31*b* and mate with guide grooves 11*a* and 11*b* of plug member 10.

Figure 6:
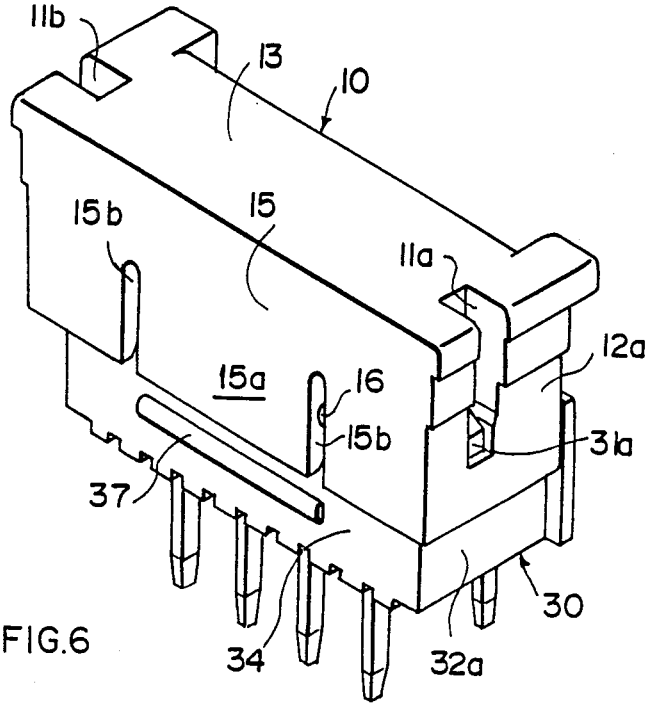
FIGS. 6 and 7 are a perspective view and a side elevational view when the electrical connector of the present invention is located at the cable receiving position.

The assembled unit of plug member 10, insulating housing 30, and a plurality of contact elements 50 corresponds to the connector shown in FIGS. 1 and 2. The rear side of the connector shown in FIG. 1 corresponds to one shown in FIG. 6 and, as apparent from FIGS. 8 and 9, an engagement groove 16 is formed on the inner surface of a central rear wall section 15*a* of rear wall 15 of the plug member 10 intersected by two slits 15*b*, 15*b*, and an engaging projection 37 formed on the outer surface of rear wall 34 of insulating housing 30.

Figure 7:
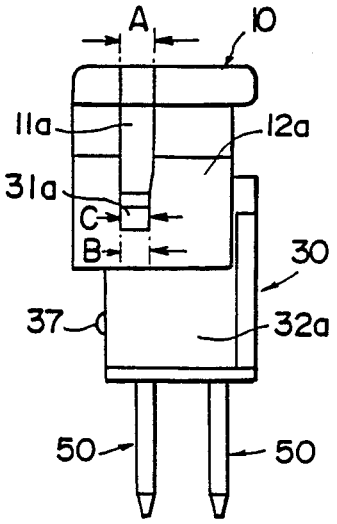

The connector is fixed to a printed circuit board so that the contact legs 53 that pass through lower wall 35 of insulating housing 30 and extend downwardly are fitted in holes in the printed circuit board. Under this condition, in order to connect flat cable 1, plug member 10 is first moved upwardly with respect to insulating housing 30 and cable 1 is then located at the cable receiving position shown in FIG. 1. FIG. 7 illustrates a left side elevational view of the connector, wherein the width of guide groove 11*a* formed in plug member 10 is made such that the width "B" and the lower end is slightly smaller than the width "A" of the other portion, and the width "C" of guide projection 31*a* to be fitted in guide groove 11*a* is smaller than width "A" and slightly larger than width "B". Due to this fact, when plug member 10 is moved upwardly and located at the cable receiving position, guide projection 31*a* is press fitted in the portion of width "B" at the lower end of guide groove 11*a* and plug member 10 is kept stationary at that position. The amount of press fitting of plug member 10 is slight and can be moved by a slight external force, that is, the plug is slidably press fitted.

Figure 8:
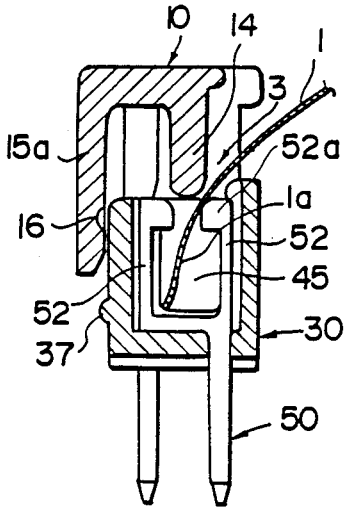
FIG. 8 is a cross-sectional view taken along line 8—8 of FIG. 1.

FIG. 8 illustrates clearance 3 formed between the upper edge of insulating housing 30 and the lower edge of projection 14 of plug member 10 such that it is possible to insert end part 1*a* of flat cable 1 into opening 45 of insulating housing 30 through clearance 3. Flat cable 1 is a flexible cable provided with a plurality of parallel conductors 2 (see FIG. 2) therein. End part 1*a* of flat cable 1 to be inserted into opening 45 has conductors 2 exposed by the desired amount.

Figure 9:
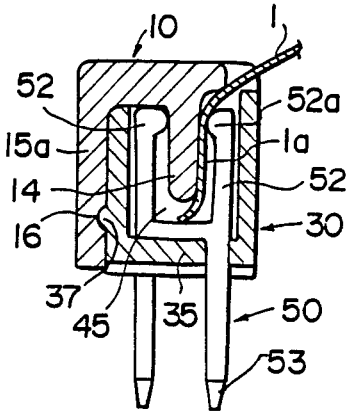
FIG. 9 is a cross-sectional view taken along line 9—9 of FIG. 2.

When the exposed conductor end part 1*a* of flat cable 1 is received in opening 45, plug member 10 is pressed downwardly. This pressing force causes press fitting between guide groove 11*a* and guide projection 31*a* to be released, while plug member 10 is moved downwardly along guide groove 11*a* and, as shown in FIG. 2, is positioned at the cable connecting position. An engaged condition between the plug member 10 and the insulating housing 30 at this cable connecting position is shown in FIG. 9.

When plug member 10 is moved downwardly from the cable receiving position to the cable connecting position, projection 14 of plug member 10 is fitted between pairs of resilient contact arms 52 of contact elements 50 within opening 45 of insulating housing 30. With this arrangement, projection 14 pushes exposed conductors 2 of flat cable 1 against contact parts 52*a* whereby flat cable 1 is electrically connected to contact elements 50. During the downward movement of projection 14, exposed conductors 2 are wipingly engaged with contact parts 52*a* so that a complete and optimum electrical connection can be attained.

At the cable connecting position, engaging projection 37 on the rear wall 34 of the insulating housing 30 is engaged with engaging groove 16 on central rear wall section 15*a* of plug member 10 and maintained at this position under a resilient force generated by rear wall section 15*a*.

As described above, according to the present invention, the plug member is slidable with respect to the insulating housing. The end part of the flat cable is inserted between the insulating housing and the plug member at the cable receiving position when the plug member is in an upper position. The plug member is then moved downwardly to the cable connecting position to enable an electrical connection between the exposed conductors of the flat cable and the contact elements within the insulating housing to be made. In order to insert or remove the flat cable, the plug member may merely be moved up and down and the flat cable can easily be connected or removed without being hindered by other components on the printed circuit board on which the present connector is mounted.

Additionally, many variations of the present invention may be practiced without departing from the spirit and scope of the present invention. For example, the contact legs of the contact elements may be modified so as to accommodate surface mounting. Additionally, different types of guide projections and guide grooves may be utilized and slightly different contact parts contained on the contact elements may be used. Further, the engagement grooves and engagement projections may be moved or different types of locking arrangements may be utilized.

What is claimed is:

1. An electrical connector for interconnecting a plurality of conductors on a flexible film substrate to conductors on a printed circuit board, the connector comprising:

an insulative housing having side walls, end walls and a floor which forms an outwardly facing opening, the side walls having a plurality of laterally spaced channels therealong, extending from the opening to the floor;

a plurality of contacts mounted within the housing, each contact comprising contact arms extending upwardly from a base portion and a tail portion extending from the base portion in the opposite direction as said contact arms, each contact being located within the housing with the contact arms within one of said channels, the contact arms being symmetrical about an axial centerline which is defined by a direction along the length of the contact arms, and having an inner contacting edge and an outer edge which is spaced from an adjacent surface of the channel, each of the contact arms of the contact being deflectable outwardly towards the adjacent surface of the channel, and the tail portion extending through an aperture in said housing floor; and a plug cap portion having an extending projection which is insertable into the insulative housing between the contact arms of the laterally spaced contacts, the plug cap portion having means allowing the plug cap portion to be movable relative to the housing between a first position allowing an access for the flexible film substrate into the housing between the extending projection and the contact arms, to a position where an end of the flexible film substrate abuts the base portions of the contacts, and a second position in which the extending projection cams the conductors on the flexible film substrate between the extending projection and one of the contact arms.

2. The connector of claim 1 wherein the housing opens upwardly with the plurality of contacts disposed vertically within the housing.

3. The connector of claim 1 wherein the tail portions extend from the contact base portions at a position which is offset from the axial centerline.

4. The connector of claim 1 wherein the contacts are installed within the housing in a configuration in which every other contact is axially rotated 180° with respect to the previous one, which defines two rows of laterally staggered tail portions extending through the housing.

5. The connector of claim 1 wherein the contacts are edge stamped from a flat plate of conductive material with the contact arms the base portion and the tail portion of each contact in the same plane.

6. The connector of claim 5 wherein the inner contacting edge is defined as a semicircular portion integral with each contact arm.

7. The connector of claim 1 further comprising a first latching means cooperatively defined by said insulative housing and said plug cap portion having a first detent position provided to define said first position of said plug cap portion.

8. The connector of claim 7 wherein the first latching means comprises guide grooves formed to extend upward and downward at both sides of said plug cap member and are fitted to guide projections which reside on outer endwalls of the housing, the guide grooves and said guide projections being slidably press fitted to each other where said plug cap member is kept stationary with respect to the insulative housing.

9. The connector of claim 7 further comprising second latching means cooperatively provided by said insulative housing and said plug cap portion profiled to define said second position of said plug cap portion.

10. The connector of claim 9 wherein the second latching means is defined by said plug cap portion having a rear wall having an engagement groove therein, the rear wall being disposed adjacent to a sidewall of said housing, the housing having a projection extending therefrom profiled relative to the engagement groove so as to retain the plug cap portion in said second position.

11. The connector of claim 1 wherein the plug cap portion includes a recessed area adjacent to a front edge thereof exposing contact arms which are adjacent to the front edge.

12. The connector of claim 11 wherein the flexible film substrate is insertable through the recessed area of the plug cap portion and between the front contact arms and the extending projection of the plug cap portion.

13. An electrical connector for interconnecting a plurality of conductors on a flexible film substrate to conductors on a printed circuit board, the connector comprising:

an insulative housing having an opening therein defined by a front sidewall, a rear sidewall, endwalls, and a floor;

a plurality of edge stamped contacts, each contact comprising a pair of contact arms upstanding from a base member, and a tail portion which extends below the base member, the contact arms, the base member and the tail portion being substantially uniplanar, the contacts being secured within the housing in lateral alignment with the tail portions extending through apertures in the floor of the housing for interconnection to a printed circuit board;

a plug cap member profiled for reception over said opening, the plug cap member comprising a cover portion which substantially encloses the opening, the cover portion including a recessed portion along a front edge thereof adjacent to the front sidewall of the connector and further comprising an extension portion extending from an underside of said cover portion which extends into the opening between the contact arms, the recessed portion being profiled to admit a flexible film substrate therein between the extension portion and the contact arms, to a position in which an end of the substrate abuts the base members of the contacts;

means to affix the plug cap portion to the housing and to allow the plug cap portion to traverse upwardly and downwardly relative to the housing, from a first flexible film substrate admitting position to a second terminated position in which the extension portion biases the conductors of the flexible film substrate against the contact arms which are adjacent the front side wall.

14. The connector of claim 13 wherein the housing sidewalls include a plurality of channels in lateral alignment for reception of the contacts therein.

15. The connector of claim 14 wherein the contact arms of the contacts are located within the channels with outer edges of each contact arm being spaced from the respective front and rear sidewalls to allow the contact arms to bias outwardly towards the sidewalls.

16. The connector of claim 13 wherein the contact arms of the contacts are symmetrical about an axial centerline defined by a direction along the length of the contact arms.

17. The connector of claim 16 wherein the tail portions are offset from the axial centerline, with alternating contacts rotated 180° with respect to the previous ones to define two rows of laterally staggered tail portions extending through the housing.

18. The connector of claim 13 wherein the traversing means comprises guide grooves formed to extend upward and downward at sides of the plug cap member, the guide grooves being profiled to overlie guide projections which reside on the outside of the endwalls, the plug cap member being movable upwardly and downwardly relative to the housing.

19. The connector of claim 18 wherein the guide grooves and said guide projections are slidably press fitted to each other when the cap is in an uppermost condition to define the first flexible film substrate admitting position.

20. The connector of claim 13 wherein said second terminated position is defined by said plug cap portion having a rear wall including an engagement groove therein, the rear wall being disposed adjacent to the rear sidewall of the housing, and the housing includes a projection extending therefrom profiled relative to the engagement groove so as to retain the plug cap portion in the second position.

* * * * *